US006147650A

United States Patent [19]

Kawahata et al.

[11] Patent Number: 6,147,650

[45] Date of Patent: Nov. 14, 2000

[54] ANTENNA DEVICE AND RADIO DEVICE COMPRISING THE SAME

[75] Inventors: Kazunari Kawahata; Shigekazu Itoh, both of Kyoto, Japan

[73] Assignee: Murata Manufacturing Co., Ltd., Japan

[21] Appl. No.: 09/252,443

[22] Filed: Feb. 18, 1999

[30] Foreign Application Priority Data

Feb. 24, 1998 [JP] Japan ..... 10-041955
Mar. 12, 1998 [JP] Japan ..... 10-061457

[51] Int. Cl.[7] ..... H01Q 1/38; H01Q 5/01

[52] U.S. Cl. ..... 343/700 MS; 343/702; 343/725

[58] Field of Search ..... 343/700 MS, 725, 343/702, 846; H01Q 1/38, 5/00, 5/01, 9/04

[56] References Cited

U.S. PATENT DOCUMENTS 5,365,246 11/1994 Rasinger et al. ..... 343/702
5,966,097 10/1999 Fukasawa et al. ..... 343/700 MS

FOREIGN PATENT DOCUMENTS 0655797 11/1994 European Pat. Off. .
0790668 2/1997 European Pat. Off. .
2749438 5/1997 France .
2067842 12/1980 United Kingdom .
2238665 11/1989 United Kingdom .
9102386 2/1991 WIPO .

*Primary Examiner*—Michael C. Wilmer
*Attorney, Agent, or Firm*—Ostrolenk, Faber, Gerb & Soffen, LLP

[57] ABSTRACT

The invention provides An antenna device, comprising: a substrate made of an insulation material and including a first major surface and a second major surface face; a ground electrode provided substantially on the whole of the first major surface of said substrate; and an inverted F-shape antenna and a microstrip antenna respectively provided on the surface of the substrate. An open end of a radiation electrode of the microstrip antenna and a feeding electrode of the inverted F-shape antenna are capacitively coupled to each other. A first direction through the open end and ground end of the radiation electrode of the inverted F-shape antenna is substantially perpendicular to a second direction through the open end and ground end of the radiation electrode of the microstrip antenna. By the above arrangement, a mutual interference hardly occurs between the two antennas.

2 Claims, 5 Drawing Sheets

ANTENNA DEVICE AND RADIO DEVICE COMPRISING THE SAME

BACKGROUND OF THE INVENTION

1. Field of the Invention

The present invention relates to an antenna device and a radio device comprising the same, and more particularly, to an antenna device adapted to use with two frequency bands and a radio device comprising the same.

2. Related Art

FIG. 6 shows an antenna device adapted to use with two frequency bands, which is a prior art of the present invention. In the antenna device 40 shown in FIG. 6, two dipole antennas 41, 42 of which the resonant frequencies are different, are arranged at an interval and connected to one signal supply 43. The antenna device can be so constructed as to be adapted to use with two frequency bands by arranging the two dipole antennas having different resonant frequencies as described above.

Furthermore, another antenna device which is also a prior art of the invention is shown in FIG. 7. Its basic arrangement is disclosed in Japanese Unexamined Patent Publication No. 7-12832. It should be noted that this antenna device was arranged in order to be used with a wider frequency band rather than with two frequency bands.

An antenna device 50 shown in FIG. 7 comprises a ground board 51, and an inverted F-shape antenna 52, and a microstrip antenna 53 arranged on the ground board 51. The inverted F-shape antenna 52 includes a first radiation conductor 52*a* having a rectangular shape and a length substantially equal to a quarter-wavelength, of which one end is open and the other end is connected to the ground board 51 through a first connecting conductor 52*b* whereby the other end functions as a ground end, and a feeding conductor 52*c* provided in the vicinity of the ground end of the first radiation conductor 52*a* and having one end connected to the first radiation conductor 52*a*. The microstrip antenna 53 includes a second radiation electrode 53*a* having a rectangular shape and a length substantially equal to a quarter-wavelength, of which one end is open and the other end is connected to the ground board 51 through a second connecting conductor 53*b* whereby the other end functions as a ground end. The open end of the second radiation conductor 53*a* of the microstrip antenna 53 is so arranged that it is positioned near to the open end of the first radiation conductor 52*a* of the inverted F-shape antenna 52, and the sides of both open ends are in parallel with each other. The resonant frequency of the microstrip antenna 53 is set to be close to that of the inverted F-shape antenna 52. A signal supply 54 is connected to the feeding conductor 52*c* of the inverted F-shape antenna 52, while the feeding conductor 52*c* is insulated from the ground board 51.

According to the antenna device 50 configured as described above, a signal, input to the inverted F-shape antenna 52 from the signal supply 54, causes the inverted F-shape antenna 52 to become resonant, and is transmitted to the microstrip antenna 53 through a static capacitance C53 produced between the open end of the first radiation conductor 52*a* of the inverted F-shape antenna 52 and the open end of the second radiation conductor 53*a* of the microstrip antenna 53, causing the microstrip antenna 53 to resonate. Thus, the inverted F-shape antenna 52 and the microstrip antenna 53 become double-resonant. That is, the antenna device 50 resonates in a wider frequency band as compared with the inverted F-shape antenna 52 solely. Thus, the antenna device 50 can be operated as an antenna adapted to use with a wider frequency band, as compared with the inverted F-shape antenna 52 solely.

However, according to the antenna device 40 shown in FIG. 6, an unnecessary interference occurs in some cases so that required characteristics can not be obtained, if the interval between the two dipole antennas 41 and 42 is short. In order to reduce the mutual interference between the two dipole antennas to a negligible level, it is required to increase the interval between the two dipole antennas to be at least 0.3 times the wavelength. As a result, this causes a problem that the antenna device as a whole becomes large in size.

Furthermore, according to the antenna device 50 shown in FIG. 7, the frequency band becomes wider to some degree as compared with that of the inverted F-shape antenna solely used, but the antenna device 50 can not be operated as an antenna adapted to use with two frequency bands not overlapped.

SUMMARY OF THE INVENTION

The object of the present invention is to provide an antenna device which is adapted to operate in two frequency bands, in which the mutual interference between two antennas constituting the antenna device is prevented, and a radio device comprising the antenna device.

One preferred embodiment of the present invention provides an antenna device, comprising: a substrate made of an insulation material and including a first major surface and a second major surface face; a ground electrode provided substantially on the whole of the first major surface of said substrate; an inverted F-shape antenna, comprising: a first radiation electrode disposed on the second major surface of said substrate and having a first open end and a first ground end; a first connecting electrode connecting said first ground end and said ground electrode; and a feeding electrode provided in the vicinity of the first ground end of said first radiation electrode and having one end connected to said first radiation electrode;

a microstrip antenna, comprising: a second radiation electrode disposed on the second main surface of said substrate and having one open second end and a second ground end; and a second connecting electrode connecting said second ground end and said ground electrode;

the second open end of said second radiation electrode of said microstrip antenna and said feeding electrode of said inverted F-shape antenna being capacitively coupled to each other; and a first direction through the first open end and the first ground end of said first radiation electrode being substantially perpendicular to a second direction through the second open end and the second ground end of said second radiation electrode.

Another preferred embodiment of the present invention provides a radio device comprising the above described antenna device and a circuit connected thereto.

According to the above described structure and arrangement, substantially no mutual interference between the two antennas (the inverted F-shape antenna and the microstrip antenna) occurs. The antenna device can be operated with two frequency bands without problems of the mutual interference, and miniaturized as well.

In addition, the above described antenna device can be operated as a circularly polarized wave antenna by setting the resonant frequencies of the two antennas to be equal to each other and setting the resonant phase difference of the two antennas at 90°.

In addition, the radio device of the present invention can be miniaturized.

Other features and advantages of the present invention will become apparent from the following description of the invention which refers to the accompanying drawings.

DESCRIPTION OF THE PREFERRED EMBODIMENTS

Figure 1:
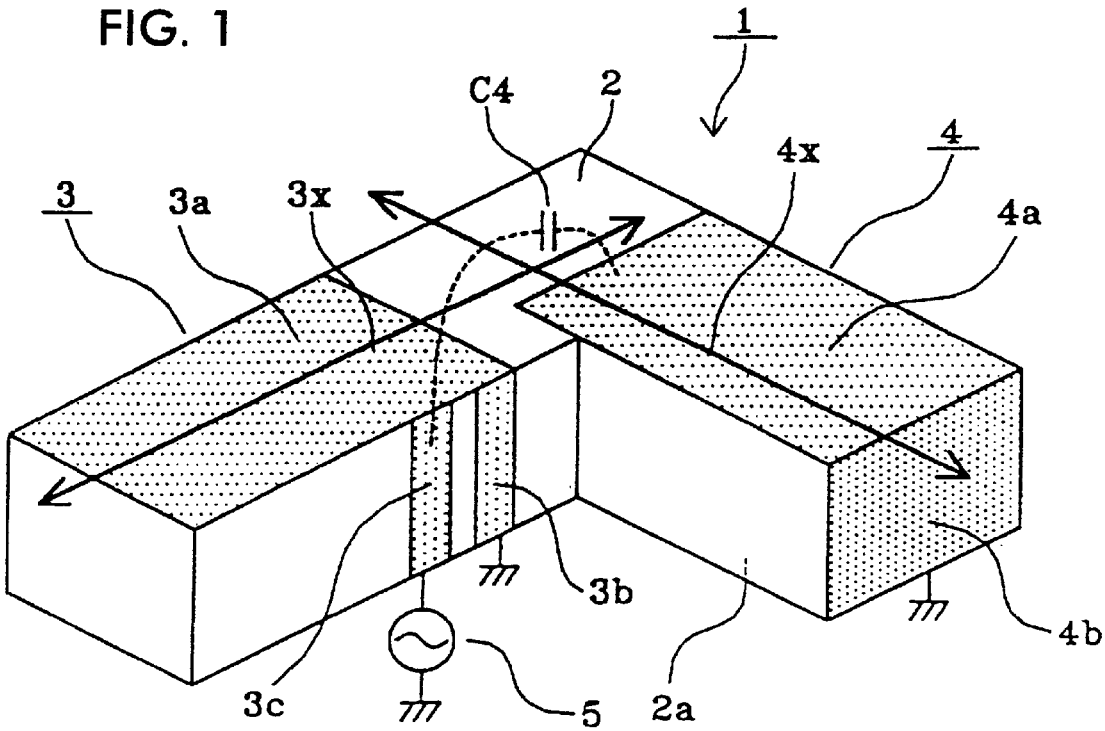
FIG. 1 is a perspective view of an antenna device according to a first preferred embodiment of the present invention.

FIG. 1 shows an antenna device according to a first preferred embodiment of the present invention. The antenna device 1 of FIG. 1 comprises a substrate 2 made of an insulation material, namely, a dielectric, and having a L-shape, a ground electrode 2*a* provided substantially on the whole of a first major surface of the substrate 2, and an inverted F-shape antenna 3 and a microstrip antenna 4 provided in the second major surface and a side surface of the substrate 2.

The inverted F-shape antenna 3 is made up of a first radiation electrode 3*a* formed in one of the linear portions which constitute the L-shaped second major surface of the substrate 2, a first connecting electrode 3*b* which is formed in one side surface of the substrate 2 and connects the other end of the first radiation electrode 3*a* to the ground electrode 2*a* whereby the other end of the first radiation electrode 3*a* functions as a ground end, and a feeding electrode 3*c* provided in the vicinity of the ground end of the first radiation electrode 3*a* and having one end connected to the first radiation electrode 3*a*. The one end of the first radiation electrode 3*a* is open. The length between the one end and the other end of the first radiation electrode 3*a* is substantially equal to a quarter-wavelength. The other end of the feeding electrode 3*c* is connected to a signal supply 5 and insulated from the ground electrode 2*a*.

The microstrip antenna 4 is made up of a second radiation electrode 4*a* formed in the other of the linear portions which constitute the L-shaped second major surface of the substrate 2, and a second connecting electrode 4*b* which is formed in one side surface of the substrate 2 and connects the other end of the second radiation electrode 4*a* to the ground electrode 2*a* whereby the other end of the second radiation electrode 4*a* functions as a ground end. The one end of the second radiation electrode 4*a* is open. The length between the one end and the other end of the second radiation electrode 4*a* is substantially equal to a quarter-wavelength.

The open end of the second radiation electrode 4*a* of the microstrip antenna 4 is positioned near to the feeding electrode 3*c* of the inverted F-shape antenna 3, and a static capacitance C4 is produced between them. The inverted F-shape antenna 3 and the microstrip antenna 4 are so arranged that directions 3*x* and 4*x* through the open ends and the ground ends of the first and second radiation electrodes 3*a* and 4*a*, respectively, are substantially perpendicular to each other. The inverted F-shape antenna 3 and the microstrip antenna 4 are so set that the frequency bands of them are different from each other.

According to the antenna device 1 configured as described above, a signal, output from the signal supply 5, is applied to the inverted F-shape antenna 3 through the feeding electrode 3*c*, and is also applied to the microstrip antenna 4 through the static capacitance C4 produced between the feeding electrode 3*c* and the open end of the second radiation electrode 4*a*. The first radiation electrode 3*a* of the inverted F-shape antenna 3 and the second radiation electrode 4*a* of the microstrip antenna 4 resonate at the quarter-wavelengths of the frequencies of the signal which is applied to the first radiation electrode 3*a* and the second radiation electrode 4*a*, respectively. That is, they are operated as antennas, so that radio waves are transmitted or received according to the respective frequency bands of the antennas. Japanese Unexamined Patent Publication No. 9-98015 discloses an antenna in which a signal is applied to a radiation electrode through a static capacitance produced between a feeding electrode and the open end of a microstrip radiation electrode.

Ordinarily, two antennas, if they are arranged near to each other, can not satisfactorily perform their functions, respectively, because of their mutual interference. On the other hand, in the antenna device 1, the first and second radiation electrodes are so arranged that the directions 3*x* and 4*x* through the open ends and the ground ends of the first and second radiation electrodes of the two antennas, respectively, are substantially perpendicular to each other. Therefore, the polarized wave planes of radio waves radiated from the two antennas are substantially perpendicular to each other, hardly causing the mutual interference between the two antennas. As a result, the antenna device 1, though it is miniaturized by positioning the two antennas near to each other, can be operated as an antenna adapted to use with the two frequency bands without problems of the mutual interference.

Figure 2:
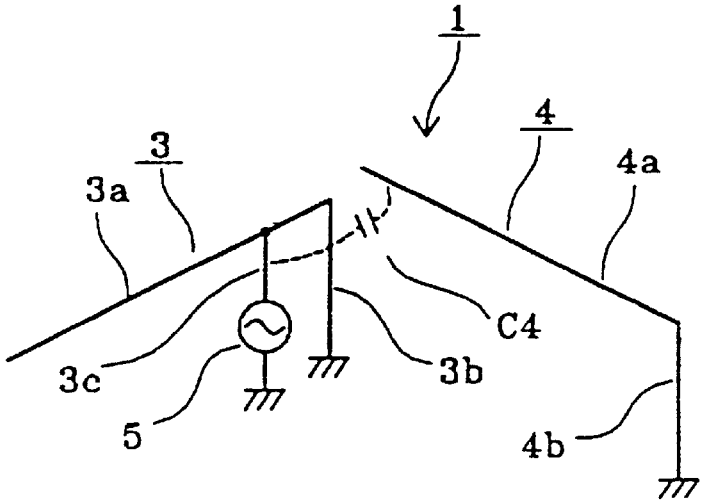
FIG. 2 is a schematic view of the antenna device of FIG. 1.

FIG. 2 schematically shows the antenna device 1 of FIG. 1. In FIG. 2, the first and second radiation electrodes 3*a* and 4*a* of the inverted F-shape antenna 3 and the microstrip antenna 4 shown in FIG. 1 are illustrated respectively in the form of a single line. These single-lines for the two radiation electrodes correspond to the directions 3*x* and 4*x* through the open ends and the ground ends of the two antennas, respectively.

As seen in the above description, the radiation electrodes of the inverted F-shape antenna and the microstrip antenna are not restricted on the rectangular shapes as shown in FIG. 1. The radiation electrodes may have any shape, for examples, a trapezoidal or triangular shape, provided that the directions through the open ends and the ground ends of the radiation electrodes of the two antennas, respectively, are substantially perpendicular to each other, as shown in FIG. 2.

Referring to FIG. 1, the guide wavelengths of a signal in the two antennas (wavelength of a signal which is propagated on the radiation electrodes) can be shortened by forming the inverted F-shape antenna 3 and the microstrip antenna 4 on the substrate 2 made of a dielectric. Accordingly, the sizes of the two antennas can be reduced.

As a result, the antenna device 1 can be miniaturized. Especially, this effect can be enhanced by employing for the substrate a dielectric having a high permittivity. In addition, the radiation electrodes are so formed as to adhere closely to the substrate. This is effective in preventing the radiation electrodes from being vibrated so that the characteristics are varied, which may be caused by an external vibration and the like.

Furthermore, since the two antennas i.e., the inverted F-shape antenna 3 and the microstrip antenna 4 are provided on the single substrate 2, the process for adjusting the directions of the two antennas is unnecessary, in contrast to the use of two separate antennas for formation of an antenna device. Assembly of the antenna device and mounting thereof on a printed circuit board can be easily achieved.

Figure 3:
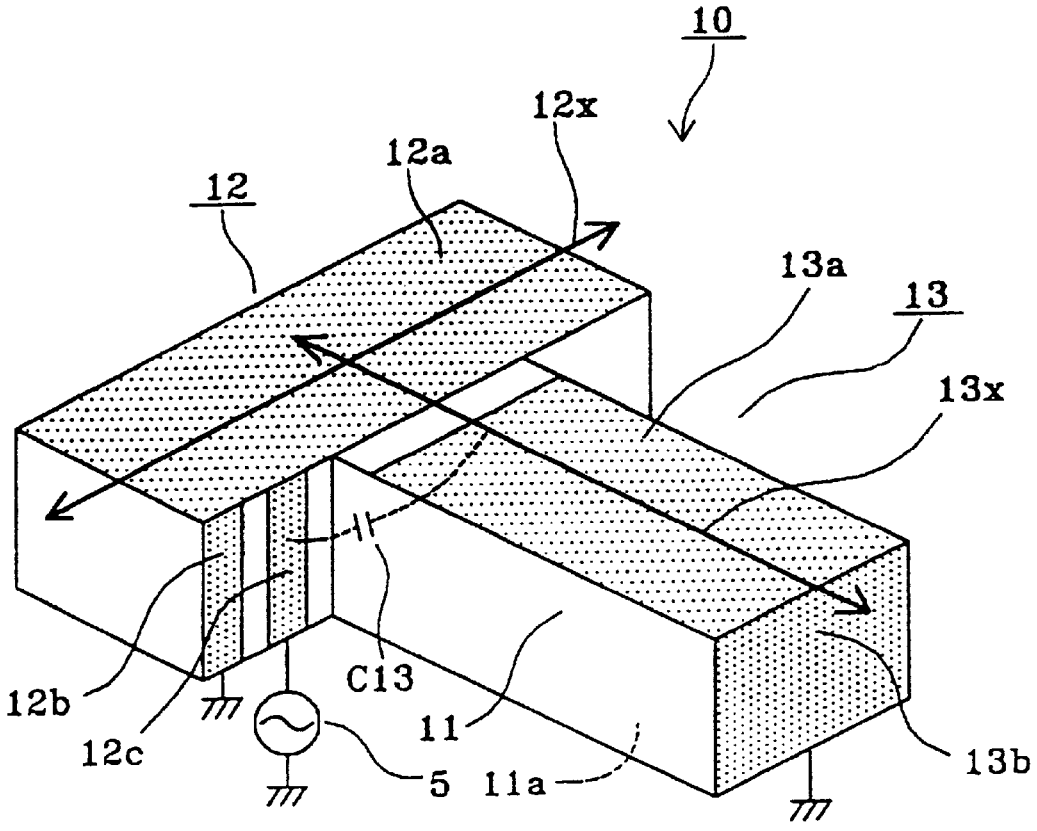
FIG. 3 is a perspective view of an antenna device according to a second preferred embodiment of the present invention.

FIG. 3 shows an antenna device according to a second preferred embodiment of the present invention. The antenna device 10 shown in FIG. 3 comprises a substrate 11 made of an insulation material, that is, a dielectric and having a T-shape, a ground electrode 11*a* formed substantially on the whole of a first major surface of the substrate 11, and an inverted F-shape antenna 12 and a micronstrip antenna 13 provided on a second major surface and a side surface of the substrate 11.

In the second preferred embodiment, the inverted F-shape antenna 12 is made up of a first radiation electrode 12*a* formed on one linear portion of the T-shaped second major surface of the substrate 11, a first connecting electrode 12*b* which is provided in one side surface of the substrate 11 and connects the other end of the first radiation electrode 12*a* to the ground electrode 11*a* whereby the other end of the first radiation electrode 12*a* functions as a ground end, and a feeding electrode 12*c* formed in the vicinity of the ground end of the first radiation electrode 12*a* and having one end connected to the first radiation electrode 12*a*. One end of the first radiation electrode 12*a* is open. The length from the one end to the other end of the first radiation electrode 12*a* is substantially equal to a quarter-wavelength. The other end of the feeding electrode 12*c* is connected to the signal supply 5 and insulated from the connecting electrode 11*a*.

The micronstrip antenna 13 is made up of a second radiation electrode 13*a* formed on the other linear portion of the T-shaped second major surface of the substrate 11, and a second electrode 13*b* provided on one side surface of the substrate 11 and connecting the other end of the second radiation electrode 13*a* to the ground electrode 11*a*. The one end of the second radiation electrode 13*a* is open. The length from the open end to the other end of the second radiation electrode 13*a* is substantially equal to a quarter-wavelength.

The open end of the second radiation electrode 13*a* of the micronstrip antenna 13 is arranged near to the feeding electrode 12*c* of the inverted F-shape antenna 12, and a static capacitance C13 is produced between them. Furthermore, the first and second radiation electrodes 12*a* and 13*a* of the inverted F-shape antenna 12 and the microstrip antenna 13 are so arranged that directions 12*x* and 13*x* through their open ends and ground ends, respectively, are substantially perpendicular to each other. Moreover, the inverted F-shape antenna 12 and the micronstrip antenna 13 are so set that their frequency bands are different.

The antenna device 10 configured as described above can be operated as an antenna adapted to use with two frequency bands, as well as the antenna device 1. With the antenna device 10, operation and advantages similar to those of the antenna device 1 can be obtained.

In FIGS. 1 and 3, the substrates have L- and T-shapes, respectively. However, the substrates are not restricted on these shapes and may take another shape such as a prism shape, a dougnut-shape, and the like. In addition, as an insulation material for the substrate, the dielectric is used. However, as the material for the substrate, a magnetic material may be employed.

In the respective above preferred embodiments, the inverted F-shape antenna and the microstrip antenna of which the frequency bands are set different are described. However, the frequency bands of the two antennas may be overlapped or made to coincide with each other. The antenna device in which the frequency bands of the two antennas are substantially coincident with each other will be described below in reference to the antenna device 1, as an example, shown in FIG. 1, which is adapted for use with a circularly polarized wave.

The inverted F-shape antenna 2 and the microstrip antenna 3 shown in FIG. 1 are so set that their frequency bands are substantially coincident with each other. According to the antenna device 1 configured as described above, a current is supplied directly to the inverted F-shape antenna 2 through the feeding electrode 2*c* and to the microstrip antenna 3 through the feeding electrode 3*c* and then the static capacitance C4. Therefore, in the two antennas, a resonant phase difference is presented with a signal having the same frequency. The resonant phase difference at the same frequency of the inverted F-shape antenna 2 and the microstrip antenna 3 can be set at 90°0 by properly setting the resonant frequencies of the inverted F-shape antenna 2 and the microstrip antenna 3 and the static capacitance C4. In the antenna device 1, by so arranging the inverted F-shape antenna 2 and the microstrip antenna 3 that the directions 3*x* and 4*x* through the open ends and the ground ends of the first and second radiation electrodes 2*a* and 3*a* are substantially perpendicular to each other, whereby the circularly polarized wave planes of the two antennas are perpendicular to each other, and moreover, setting the resonant phase difference of the two antennas at 90°, the antenna device 1 can be operated as a circularly polarized wave antenna.

Figure 4:
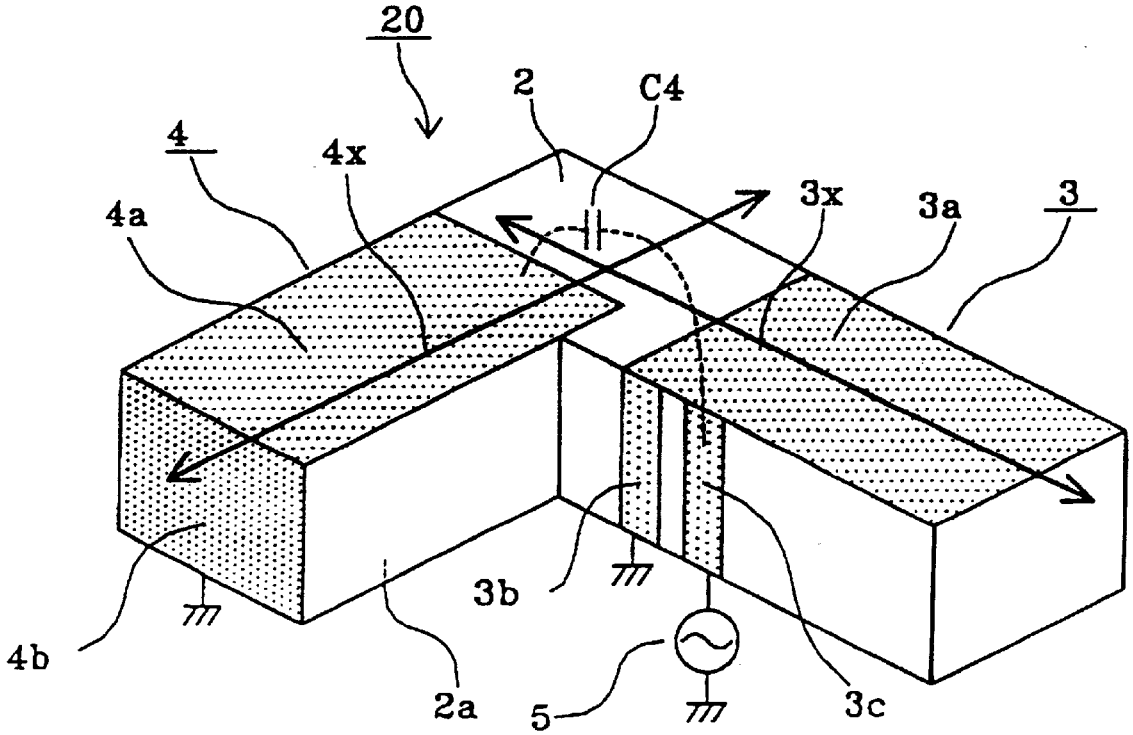
FIG. 4 is a perspective view of an antenna device according to a third preferred embodiment of the present invention.

According to the antenna device 1, the circularly polarized wave is a fixed wave, that is, a right-handed or left-handed polarized wave. As seen in an antenna device 20 of a third preferred embodiment shown in FIG. 4, the rotation direction of the circularly polarized wave can be reversed by changing the position of the microstrip antenna 4 with respect to the inverted F-shape antenna 3. In FIG. 4, the positional relation between the inverted F-shape antenna 3 and the microstrip antenna 4 is merely changed. Like or the same parts in FIGS. 1 and 4 are designated by the same reference numerals. The description of the parts in reference to FIG. 4 is omitted.

Figure 5:
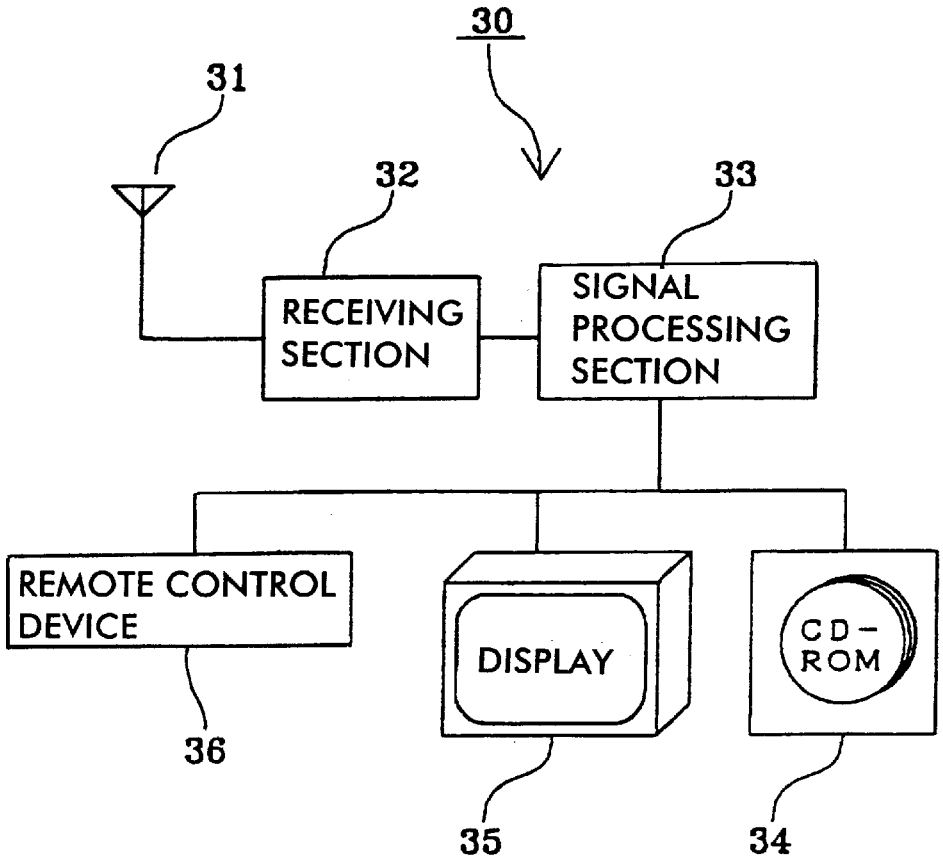
FIG. 5 is a block diagram of a radio device according to a fourth preferred embodiment of the present invention.
Figure 6:
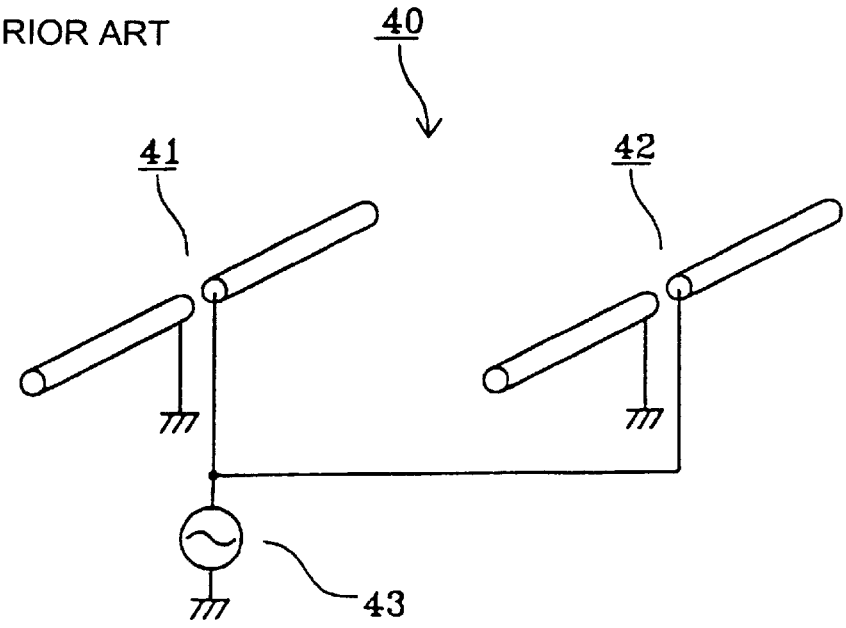
FIG. 6 PRIOR ART
FIG. 6 is a perspective view of an antenna device which is a prior art of the present invention.
Figure 7:
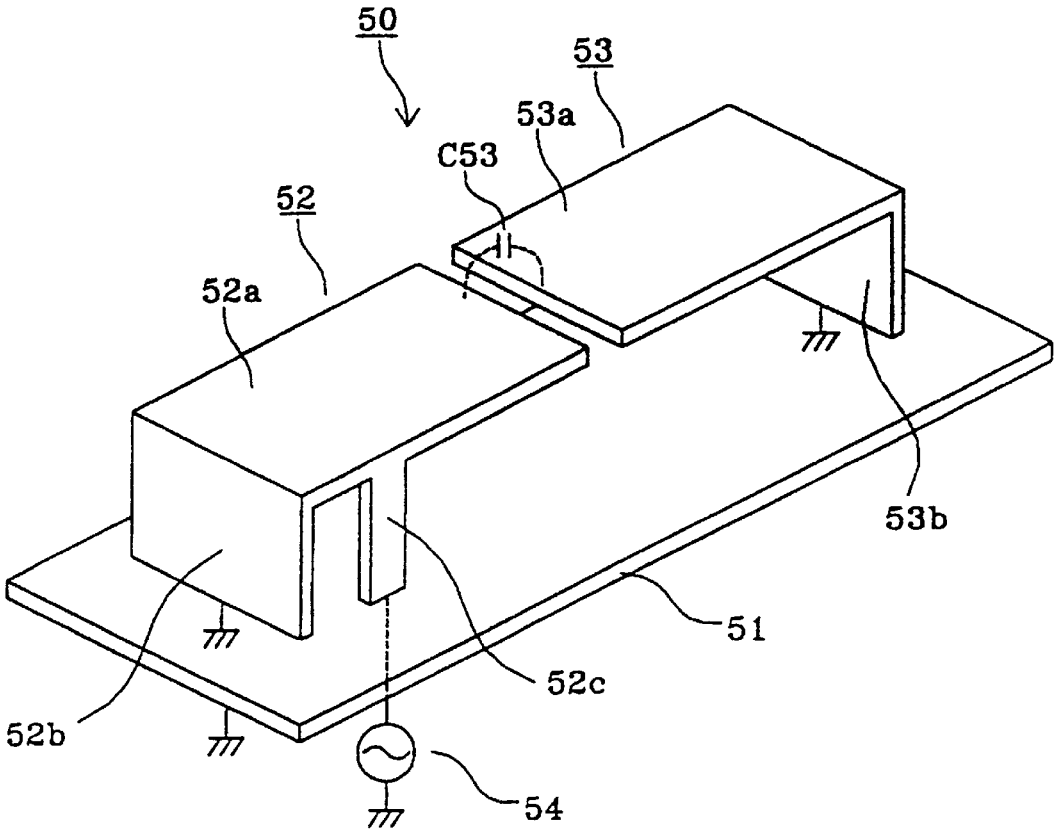
FIG. 7 PRIOR ART
FIG. 7 is a perspective view of another antenna device which is a prior art of the present invention.

A fourth preferred embodiment of the present invention shown in FIG. 5. is a navigation system including a radio device of the present invention which utilizes the circularly polarized wave.

In FIG. 5, a radio device 30 comprises an antenna section 31 which is the antenna device 1 of the present invention configured as a circularly polarized wave antenna, provided with a radome and accommodated in a case, a receiving section 32 connected to the antenna section 31, a signal processing section 33 connected to the receiving section 32, and a map system 34, a display 35, and an interface section 36 connected to the signal processing section 33, respectively. The antenna section 31 receives radio waves from plural GPS satellites. The receiving section 32 picks up various signals from the radio waves. The signal processing section 33, based on the received signals, determines the present location of the radio device 30 itself, that is, that of a motorcar in which the radio device 30 is mounted, and indicates the location on the display 35 in cooperation with the map system 34 having a map software in the form of CD-ROM and the like, and the interface section 36 such as a remote control device and the like.

According to the navigation system embodying a radio device equipped with the antenna device of the present invention, configured as described above, the radio device itself can be miniaturized, and its cost saving can be achieved. In addition, by the miniaturization, the design flexibility of the space where the antenna is to be placed is increased, and thereby, the cost of the installation of the navigation system, for example, in a motorcar can be reduced.

The radio device 34 is constructed by use of the antenna device 1, as described above. Radio devices configured by using the antenna devices 10 and 20 shown in FIGS. 3 and 4, respectively also present similar operation and advantages.

While the invention has been particularly shown and described with reference to preferred embodiments thereof, it will be understood by those skilled in the art that the forgoing and other changes in form and details may be made therein without departing from the spirit of the invention.

What is claimed is:

1. An antenna device, comprising:

a substrate made of an insulation material and including a first major surface and a second major surface face;

a ground electrode provided substantially on the whole of the first major surface of said substrate;

an inverted F-shape antenna, comprising: a first radiation electrode disposed on the second major surface of said substrate and having a first open end and a first ground end; a first connecting electrode connecting said first ground end and said ground electrode; and a feeding electrode provided in the vicinity of the first ground end of said first radiation electrode and having one end connected to said first radiation electrode;

a microstrip antenna, comprising: a second radiation electrode disposed on the second main surface of said substrate and having one open second end and a second ground end; and a second connecting electrode connecting said second ground end and said ground electrode;

the second open end of said second radiation electrode of said microstrip antenna and said feeding electrode of said inverted F-shape antenna being capacitively coupled to each other; and a first direction through the first open end and the first ground end of said first radiation electrode being substantially perpendicular to a second direction through the second open end and the second ground end of said second radiation electrode.

2. A radio device comprising an antenna device and a circuit connected to the antenna device;

said antenna device comprising:

a substrate made of an insulation material and including a first major surface and a second major surface face;

a ground electrode provided substantially on the whole of the first major surface of said substrate;

an inverted F-shape antenna, comprising: a first radiation electrode disposed on the second major surface of said substrate and having a first open end and a first ground end; a first connecting electrode connecting said first ground end and said ground electrode; and a feeding electrode provided in the vicinity of the first ground end of said first radiation electrode and having one end connected to said first radiation electrode;

a microstrip antenna, comprising: a second radiation electrode disposed on the second main surface of said substrate and having one open second end and a second ground end; and a second connecting electrode connecting said second ground end and said ground electrode;

the second open end of said second radiation electrode of said microstrip antenna and said feeding electrode of said inverted F-shape antenna being capacitively coupled to each other; and a first direction through the first open end and the first ground end of said first radiation electrode being substantially perpendicular to a second direction through the second open end and the second ground end of said second radiation electrode.

* * * * *